United States Patent [19]

Flamme et al.

[11] 4,344,312

[45] Aug. 17, 1982

[54] FORMING PRESS WITH A CAM ARRANGEMENT

[75] Inventors: Walter Flamme, Wegberg-Beeckerheide; Oskar Rahn, Kempen, both of Fed. Rep. of Germany

[73] Assignee: Peltzer & Ehlers GmbH & Co., Krefeld, Fed. Rep. of Germany

[21] Appl. No.: 116,211

[22] Filed: Jan. 28, 1980

[51] Int. Cl.[3] ..... B21J 9/10

[52] U.S. Cl. ..... 72/452; 10/11 R; 74/568 R

[58] Field of Search ..... 72/452, 450, 429; 74/568 R; 10/11 R, 12 R

[56] References Cited

U.S. PATENT DOCUMENTS

| | | | |
|---|---|---|---|
| 1,561,902 | 11/1925 | Berry | 72/452 |
| 2,216,318 | 10/1940 | Lewis | 74/568 |
| 2,473,287 | 6/1949 | Maloney | 74/568 |
| 3,285,095 | 11/1966 | Rockola | 74/568 |
| 3,289,494 | 12/1966 | Gaffney | 74/568 |
| 3,331,254 | 7/1967 | Stoll | 74/568 |
| 4,079,474 | 3/1978 | Tanaka | 10/12 T |

FOREIGN PATENT DOCUMENTS

| | | |
|---|---|---|
| 634637 | 8/1936 | Fed. Rep. of Germany . |
| 647639 | 7/1937 | Fed. Rep. of Germany . |
| 739348 | 9/1943 | Fed. Rep. of Germany . |

*Primary Examiner*—Gene Crosby

*Attorney, Agent, or Firm*—Shlesinger, Arkwright, Garvey & Dinsmore

[57] ABSTRACT

An adjustable cam arrangement is provided for controlling various work handling elements of a multistage press. Releasable cam disc members are mounted on a camshaft for actuating a respective cam follower associated with a work handling element. The cam disc members are drivingly coupled to the camshaft in response to a supply of fluid pressure. The cam disc members contain a pair of cam discs adjustable by a motor for independently rotating the cam discs relative to the camshaft for varying the duration and timing of work handling elements.

7 Claims, 3 Drawing Figures

FORMING PRESS WITH A CAM ARRANGEMENT

The invention concerns a forming press, particularly a multistage press, with a cam arrangement, for example for actuating tongs for transporting a workpiece from one stage to the next, or from the shearing station to the press stage, or for actuating a shear or actuating the ejector pin in an ejector mechanism, whereby the cam arrangement comprises a camshaft with at least one releasable cam disc attached to it, and whereby an actuating organ runs over or rolls over said cam disc.

Typically, forming presses, particularly multistage presses, have for transporting a workpiece from one stage to the next or from the shearing station to the first press stage a series of tongs the motion of which is controlled by a cam arrangement. This cam arrangement comprises a camshaft driven by the forming press, and one or more—usually several—cam discs attached to the camshaft. The attachment of the cam discs is accomplished with supports attached to the camshaft and having Hirth-type serrations. In this way cam discs can be rotated with respect to the camshaft after releasing the attaching means, whereby the course of motion of the gripping tongs can be shifted in time.

Often there may be sets of cam discs instead of individual cam discs, attached to the camshaft. In these each cam disc set comprises two tightly adjoining cam discs with usually identical cam profiles, over which the control organ for actuating the tongs runs simultaneously. These two cam discs can be rotated both relative to the camshaft and to each other, whereby the time the tongs remain in the press space can be increased. This dwell time can also be further increased by providing an intermediate disc which operates in concert with the cam disc set, and typically is disposed between the two cam discs and has a cam disc segment for covering the gap produced when the two outer cam discs are strongly rotated with respect to each other.

Cam arrangements of the type described may also be used for other purposes, e.g. for controlling a shear knife or an ejector pin.

The rotation of the cam discs relative to the camshaft and to each other must be carried out by hand with known forming presses, after loosening a set of attaching means. Without requiring detailed description it may be stated that this is a complex process and takes a great deal of time, especially with multistage presses. Thus the problem underlying the invention is to substantially simplify and shorten the process of setting the cam discs.

This problem is solved according to the invention in that the cam disc(s) are couplable to the camshaft by means of a clamping mechanism which can be supplied with a pressure medium under pressure, and are couplable to at least one servo motor for rotating the cam disc(s) relative to the camshaft. With this design the cam discs can be rotated with respect to the camshaft by actuating the servo motor, whereby the coupling between the cam discs and the camshaft can be rapidly loosened or retightened by appropriate supply of the pressurized pressure medium.

In the design according to the invention it is provided that at least one cam disc set is mounted on the camshaft, with each set having two tightly adjacent but relatively rotatable cam discs, and with each such disc being couplable to the servo motor by its own coupling means. In this way the respective control organ may not only have its actuating time shifted but also its duration of operation may be controlled. Multiple sets of cam discs may be mounted on the camshaft as needed.

According to another feature of the invention it is provided that an intermediate disc with a cam segment is mounted between each pair of adjacent cam discs, and the motion of said intermediate disc is confined by means of a coupling through pin to the bounds of longitudinal i.e., circumferential openings in the two cam discs. In this way the duration of the cam-control action on the respective control organ may be further increased.

In another embodiment of the invention it is provided that the coupling means comprises a spur gear coupled to each cam disc, and a control pinion engaging each spur gear, said pinion being couplable to a control shaft driven by the servo motor. Herewith each pinion may be couplable to the drive shaft by a magnetically switchable gear coupling. Preferably all the pinions should be mounted along a single drive shaft driven by a servo motor, so that only this one motor is needed.

According to a further feature of the invention it is provided that the clamping mechanism is in the form of a hydraulic collet, with one such collet optionally provided for each cam disc or each cam disc set.

It is further proposed according to the invention that the servo motor is advantageously combined with a step indicator, so that the adjusting process may be monitored at any time.

The invention is illustrated in more detail in the drawings, with an example embodiment.

FIG. 1 shows a cam arrangement 1 of a five-stage press for controlling gripping tongs designed for transporting a workpiece from one stage to the next.

Figure 1:
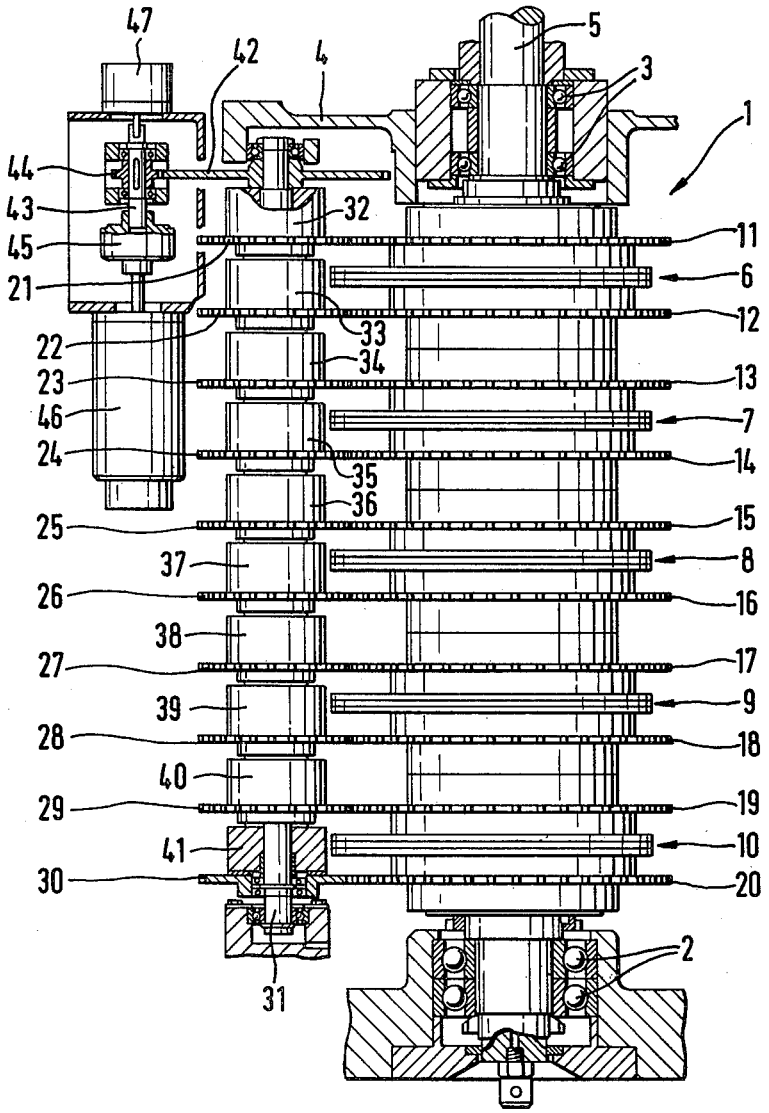
FIG. 1 is a side view of a cam arrangement of a five-stage press.

Cam arrangement 1 has a camshaft 5 which is rotatably mounted on roller bearings 2 and 3 on machine frame 4. Five sets of cam discs 6 through 10 are mounted on the camshaft. When the five-stage press is operating, the sets of cam discs are rigidly connected to camshaft 5, but they can be disconnected for adjusting.

Figure 2:
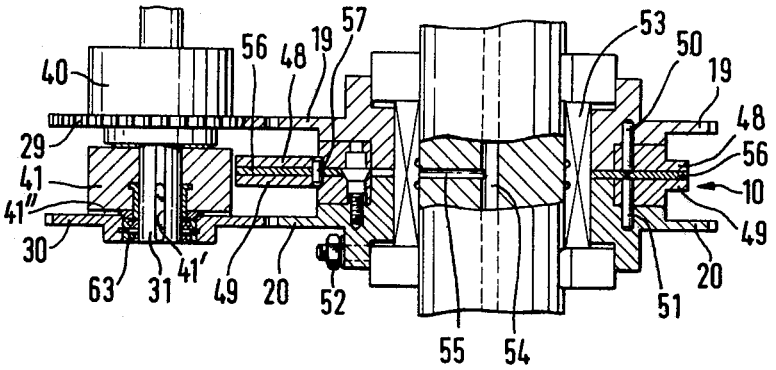
FIG. 2 is a cross section through a set of cam discs of the cam arrangement of FIG. 1.

As is seen more clearly from FIG. 2, each set of cam discs 6 through 10 comprises two cam discs and one intermediate disc, with each cam disc being a spur gear 11 through 20.

Each spur gear 11 through 20 meshes with a control pinion or drive gear 21 through 30 which is fixed to a control shaft 31 located next to camshaft 5. A magnetically shiftable gear coupling 32 through 41 is provided for each control pinion 21 through 30. By means of electrical control of these gear couplings 32 through 41 the respective pinions 21 through 30 of the control shaft are engaged, whereby each such pinion on control shaft 31 rotates the spur gear of 11 through 20 which meshes with it, and rotates the cam disc connected to said spur gear, such rotation being relative to control shaft 5.

Control shaft 31 has a drive spur gear 42 at its upper end which engages a drive pinion 44 mounted on the motor drive shaft 43 which in turn is connected on one end of a servo motor 46 by an elastic coupling 45 and on the other end of a step indicator 47 which serves to indicate the current setting of the motor drive shaft 44. With the aid of servo motor 46 the cam discs may thus be rotated and their gear couplings 32 through 41 may be controlled.

FIG. 2 is a cross section of the lowest cam disc set 10 of the sets 6 through 10 represented in FIG. 1. The design of the cam disc set may be seen from this view. As already mentioned, cam disc set 10 comprises two cam discs 48 and 49 which are bolted to respective adjoining spur gears 19 and 20 by means of coupling through pins 50 and 51, and bolts 52. Spur gears 19 and 20 may be coupled to camshaft 5 by a common collet 53, supplied with hydraulic fluid under pressure via an axial supply channel 54 and a radial branch channel 55. This collet 53 may, for example, be of a well known hydraulic collet type such as disclosed in German Pat Nos. 634,637, 647,639 or 739,348.

An intermediate disc 56 is disposed between cam discs 48 and 49 and is connected to the latter only through a (second) coupling through pin 57. This common coupling through pin is confined in respective longitudinal openings 61 and 62 which run circumferentially, as seen from FIG. 3 which shows a side view of cam disc set 10.

Figure 3:
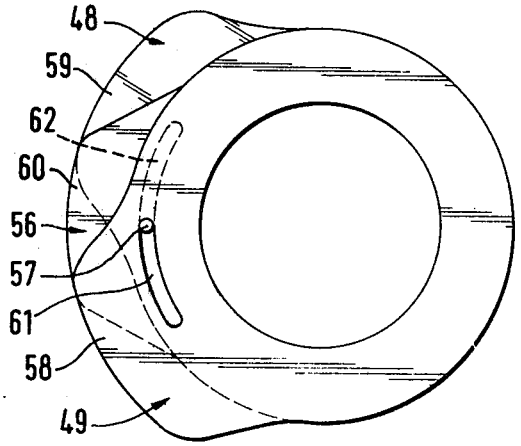
FIG. 3 is a top view of the set of cam discs of FIG. 2.

It can be seen from this FIG. 3 that the identically shaped cam discs 48 and 49 are rotated so far in opposite directions that a normally unwanted gap is produced between the two cams 58 and 59. This gap is covered by a suitable cam 60 on intermediate disc 56, producing a large angular extent over which the control surface (not shown) runs, over a diameter which is larger than that of the base circle.

To cause the intermediate disc 56 to move accurately into this gap, longitudinal openings 61 and 62 (already mentioned) are provided in the respective cam discs 48 and 49, which openings suitably confine the freedom of movement of intermediate disc 56, by means of coupling through pin 57. In the extreme oppositely rotated position of cam discs 48 and 49 which is shown, this coupling through pin 57 lies up against the opposite ends of the respective longitudinal openings 61 and 62.

FIG. 2 also shows that the two spur gears 19 and 20 for setting cam discs 48 and 49 engage the two respective control pinions 29 and 30 which are rotatably mounted on control shaft 31 by means of roller bearings 63. When the forming press is operated, the two pinions rotate with cam discs 48 and 49 accordingly, and with their spur gears 19 and 20. For the setting process, during which the camshaft 5 is stationary, the control pinions 29 and 30 may each be coupled to the control shaft 31 independently from the other, via the respective gear couplings 40 and 41. If only one of the two gear couplings 40 and 41 associated with cam disc set 10 is controlled, then only one of the cam discs 48 and 49 is rotated with respect to camshaft 5, so that the extent or side of the cam is made wider. If, on the other hand, both gear couplings 40 and 41 are subjected to control action simultaneously, then only an angular shift occurs, without a change in the overall cam shape. The gear couplings are of conventional design wherein the coupling 41, for example, is splined to the shaft 31 at 41' for rotation therewith, and couplable with the control pinion 30 by the gear teeth 41'' upon actuation of a magnetic actuator in the coupling.

Cam disc sets 6 through 9 shown in FIG. 1 have the same design as set 10, which latter set is shown in more detail in FIG. 2.

We claim:

1. A multistage forming press having means for selectively controlling the operation of a plurality of work handling elements associated with said press, said controlling means comprising a camshaft having at least one releasable cam disc member mounted thereon for actuating a cam follower associated with said cam disc member and connected to at least one of said work handling elements, means for drivingly coupling said cam disc member and said camshaft in response to a supplied pressure medium under pressure, and adjusting motor means couplable to said cam disc member for rotating said cam disc member relative to said camshaft for varying the duration and timing of said cam disc member and thereby controlling said work handling elements.

2. A forming press as in claim 1 and wherein said cam disc member comprises a pair of cam discs and said adjusting motor means includes means for independently rotating said cam discs relative to said camshaft.

3. A forming press as in claim 2 and wherein said cam disc member further includes an intermediate disc mounted on said camshaft and positioned between said cam discs, an arcuate slot formed in each of said cam discs, a pin member mounted in said intermediate disc and extending into the slot in each of the adjacent discs for limiting the extent of relative movement of said cam discs.

4. A forming press as in claim 3 and wherein said adjusting motor means includes a spur gear coupled to each cam disc and pinion gear mounted on a control shaft parallel to said camshaft associated with each of said spur gears, said pinion gears being selectively couplable to said control shaft, said adjusting and motor means rotating said control shaft and thereby selectively rotating said pinion gears, said spur gears and said cam discs.

5. A forming press as in claim 4 and including magnetically shiftable gear couplings for connecting said pinion gears to said control shaft.

6. A forming press as in claim 5 and wherein said means for drivingly coupling said cam disc member and said camshaft comprises a hydraulic collet.

7. A forming press as in claim 6 and wherein said motor means comprises a servo motor having a step indicator.

* * * * *